US007967503B1

(12) United States Patent
McGowen et al.

(10) Patent No.: US 7,967,503 B1
(45) Date of Patent: Jun. 28, 2011

(54) ACCESSORY STORAGE COMPARTMENT

(76) Inventors: Amy McGowen, Bakersfield, CA (US); Debra Yadon, Bakersfield, CA (US)

( * ) Notice: Subject to any disclaimer, the term of this patent is extended or adjusted under 35 U.S.C. 154(b) by 125 days.

(21) Appl. No.: 12/358,018

(22) Filed: Jan. 22, 2009

(51) Int. Cl.
*G04B 37/12* (2006.01)

(52) U.S. Cl. ..... 368/278; 368/10; 368/313; 312/326

(58) Field of Classification Search ..... 368/278, 368/284, 309, 311–313, 316–317; 312/326–327, 312/300, 310, 321.5, 248
See application file for complete search history.

(56) References Cited

U.S. PATENT DOCUMENTS 258,720 A * 5/1882 McKee ..... 223/107
358,488 A 9/1900 Levy et al.
1,128,477 A * 2/1915 Johnson ..... 312/224
3,613,873 A 10/1971 Schulman
D235,523 S * 6/1975 Miller ..... D10/2
3,930,702 A 1/1976 Pichowicz
D244,358 S 5/1977 Neal
4,319,683 A * 3/1982 Correa, III ..... 206/349
4,371,077 A 2/1983 Solitt et al.
5,035,319 A * 7/1991 Kunisch ..... 206/6.1
5,429,432 A * 7/1995 Johnson ..... 312/235.3
5,708,629 A * 1/1998 Hung-Hsu ..... 368/73
D393,542 S * 4/1998 Thompson ..... D3/294
6,584,042 B1 6/2003 Serafini et al.
7,389,868 B2 * 6/2008 Lewand et al. ..... 206/6.1

* cited by examiner

*Primary Examiner* — Sean Kayes

(57) ABSTRACT

An accessory storage compartment that also functions as a clock comprising a front face, a back face, a first side, and a second side. The storage compartment can be opened to form a first half and a second have via a hinge. A button clasp secures the two halves together. Inside the storage compartment is an earring grid for holding earrings, a ring holding apparatus, and a plurality of hooks for holding necklaces, bracelets, and the like. Disposed on the front face of the compartment is a clock.

3 Claims, 4 Drawing Sheets

ACCESSORY STORAGE COMPARTMENT

FIELD OF THE INVENTION

The present invention is directed to a storage compartment for accessories. More particularly, the present invention is directed to an accessory storage compartment in the form of a clock.

BACKGROUND OF THE INVENTION

The present invention features an accessory storage compartment that also functions as a clock comprising a front face, a back face, a first side, and a second side. The storage compartment can be opened to form a first half and a second have via a hinge. A button clasp secures the two halves together. Inside the storage compartment is an earring grid for holding earrings, a ring holding apparatus, and a plurality of hooks for holding necklaces, bracelets, and the like. Disposed on the front face of the compartment is a clock. An inner compartment inside the accessory storage compartment can hold a variety of items such as watches, necklaces, the like, or a combination thereof. The inner compartment has a door that can be opened and closed via a hinge.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 2:
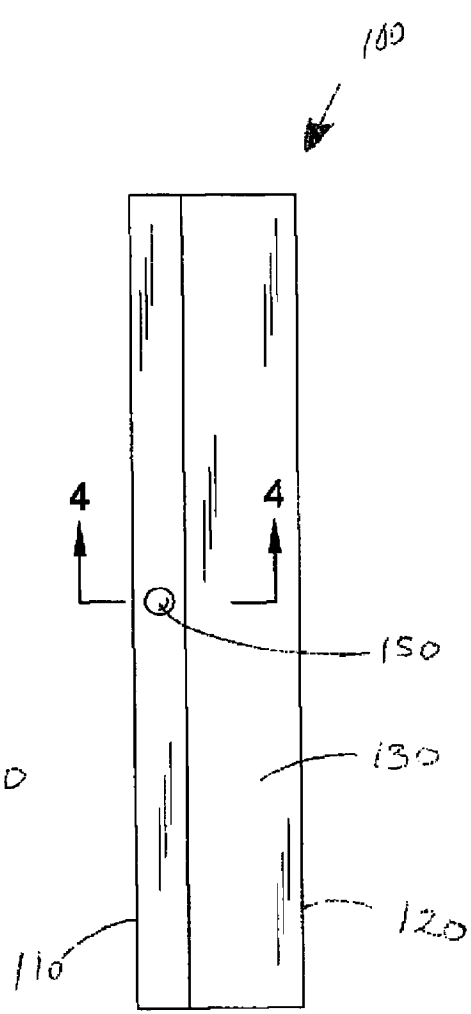
FIG. 2 is a side view of the accessory storage compartment of the present invention.
Figure 1:
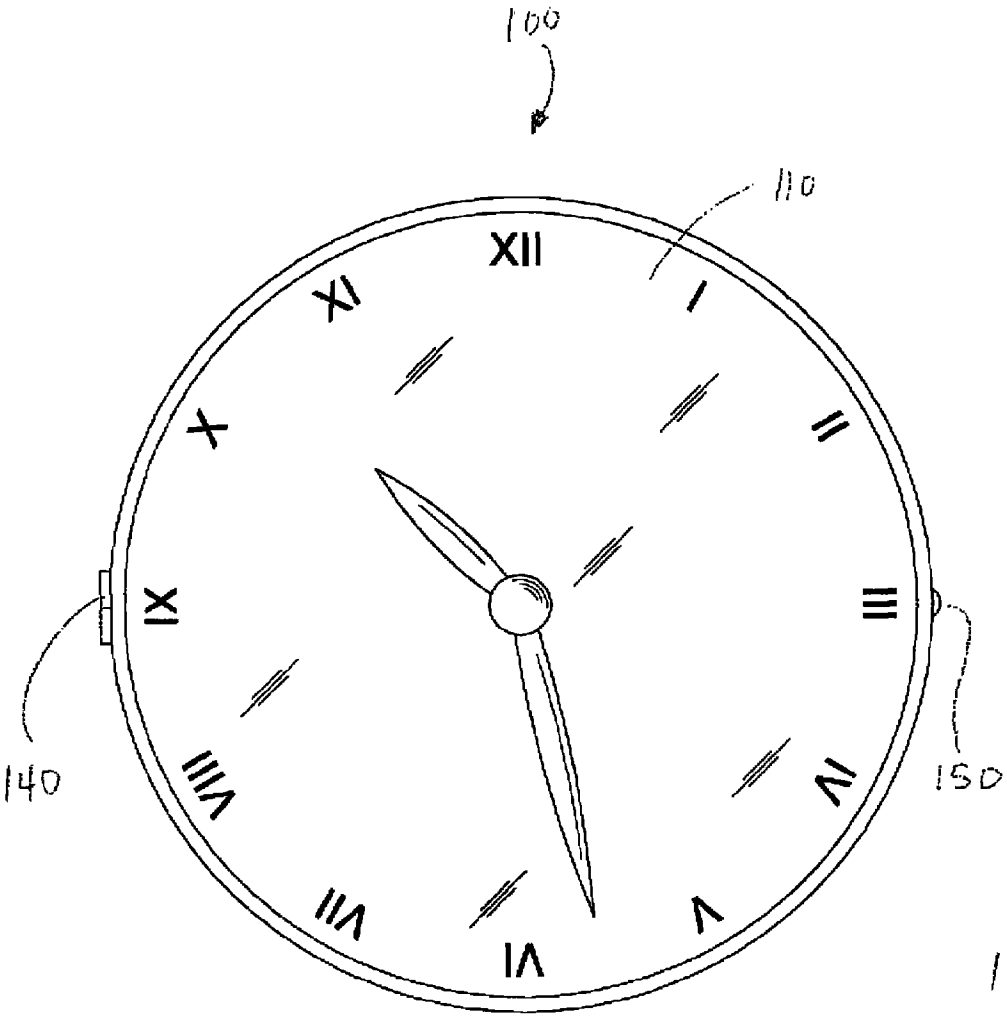
FIG. 1 is a front view of the accessory storage compartment of the present invention.

The following is a listing of numbers corresponding to a particular element refer to herein:

100 accessory storage compartment
110 front face of accessory storage compartment
111 inside surface of front face
120 back face of accessory storage compartment
121 inside surface of back face
130 side of accessory storage compartment
135 notch
140 hinge
150 button clasp
200 time control panel

210 inner compartment
250 inner compartment door
300 ring holding apparatus
310 hook
350 earring grid
355 post
400 mounting hole
450 clasp Referring now to FIGS. 1-7, the present invention features an accessory storage compartment 100 that also functions as a clock. The accessory storage compartment 100 comprises a front face 110, a back face 120, a first side 130, and a second side 130. The first side 130 and the second side 130 are both openable via a hinge 140 disposed on the first side 130, forming a first half of the accessory storage compartment 100 and a second half of the accessory storage compartment 100. The first half and the second half can be secured together via a button clasp 150 disposed on first half of the accessory storage compartment 100 on the second side 130. The button clasp 150 can hook into a notch 135 disposed on the second half of the accessory storage compartment 100 on the second side 130 (see FIG. 4).

The front face 110 of the accessory storage compartment 100 has an inside surface 111, and the back face 120 of the accessory storage compartment 100 has an inside surface 121. Disposed on the front face 110 of the accessory storage compartment 100 is a clock controlled by a time control panel 200 disposed on the inside surface 111 of the front face 110. The time control panel 200 includes a means of setting the clock.

In some embodiments, a plurality of hooks 310 are attached to the inside surface 121 of the back face 120 of the accessory storage compartment 100 for hanging items such as necklaces, bracelets, chains, the like, or a combination thereof. In some embodiments, a ring holding apparatus 300 is attached to the inside surface 121 of the back face 120 of the accessory storage compartment 100 for holding rings, earrings, the like, or a combination thereof. In some embodiments, an earring grid 350 is attached to the inside surface 121 of the back face 120 of the accessory storage compartment 100 via one or more posts 355. The earring grid 350 is for holding earrings, the like, or a combination thereof.

Disposed on the back face 120 of the accessory storage compartment 100 are one or more mounting holes 400. The mounting holes 400 are for receiving a nail, bolt, screw, or the like, so as to mount the accessory storage compartment 100 on a wall or other similar structure.

Figure 3:
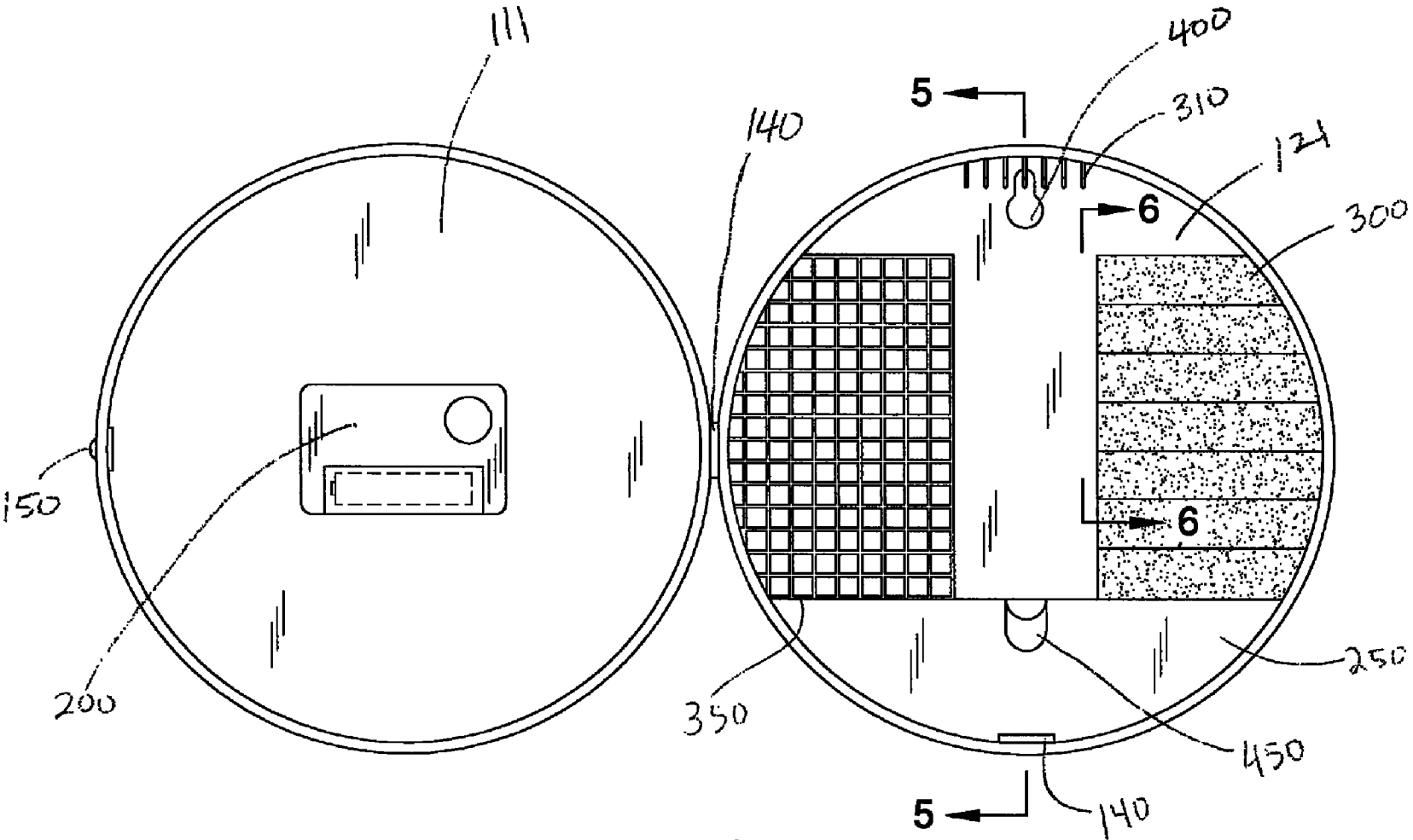
FIG. 3 is a front view and of the accessory storage compartment of the present invention, wherein the sides are opened to show the first half and the second half.
Figure 6:
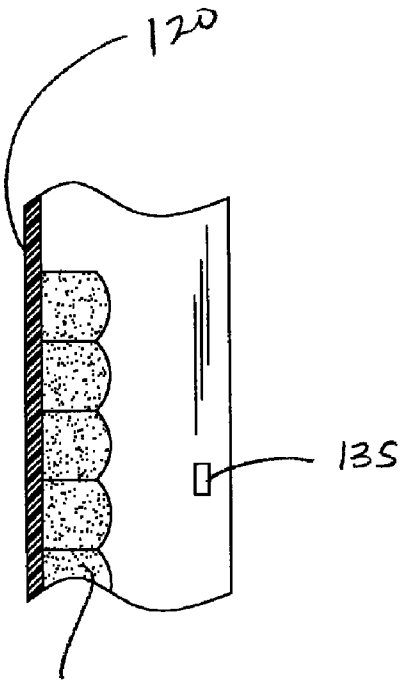
FIG. 6 is a side view and cross-sectional view of the ring holding apparatus of the accessory storage compartment of the present invention.
Figure 5:
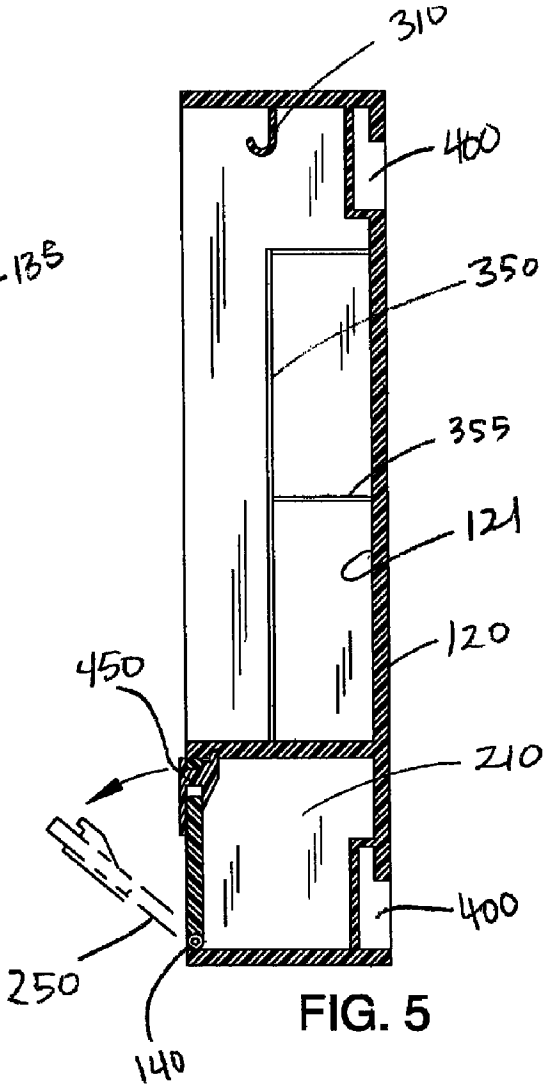
FIG. 5 is a side view and cross-sectional view of the accessory storage compartment of the present invention.
Figure 4:
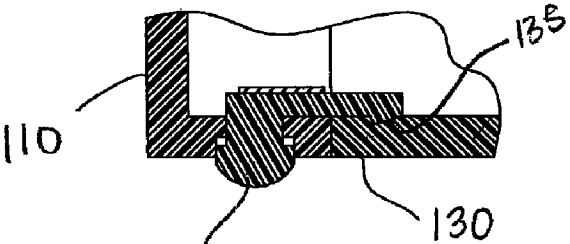
FIG. 4 is a cross-sectional view of the button clasp of the accessory storage compartment of the present invention.
Figure 7:
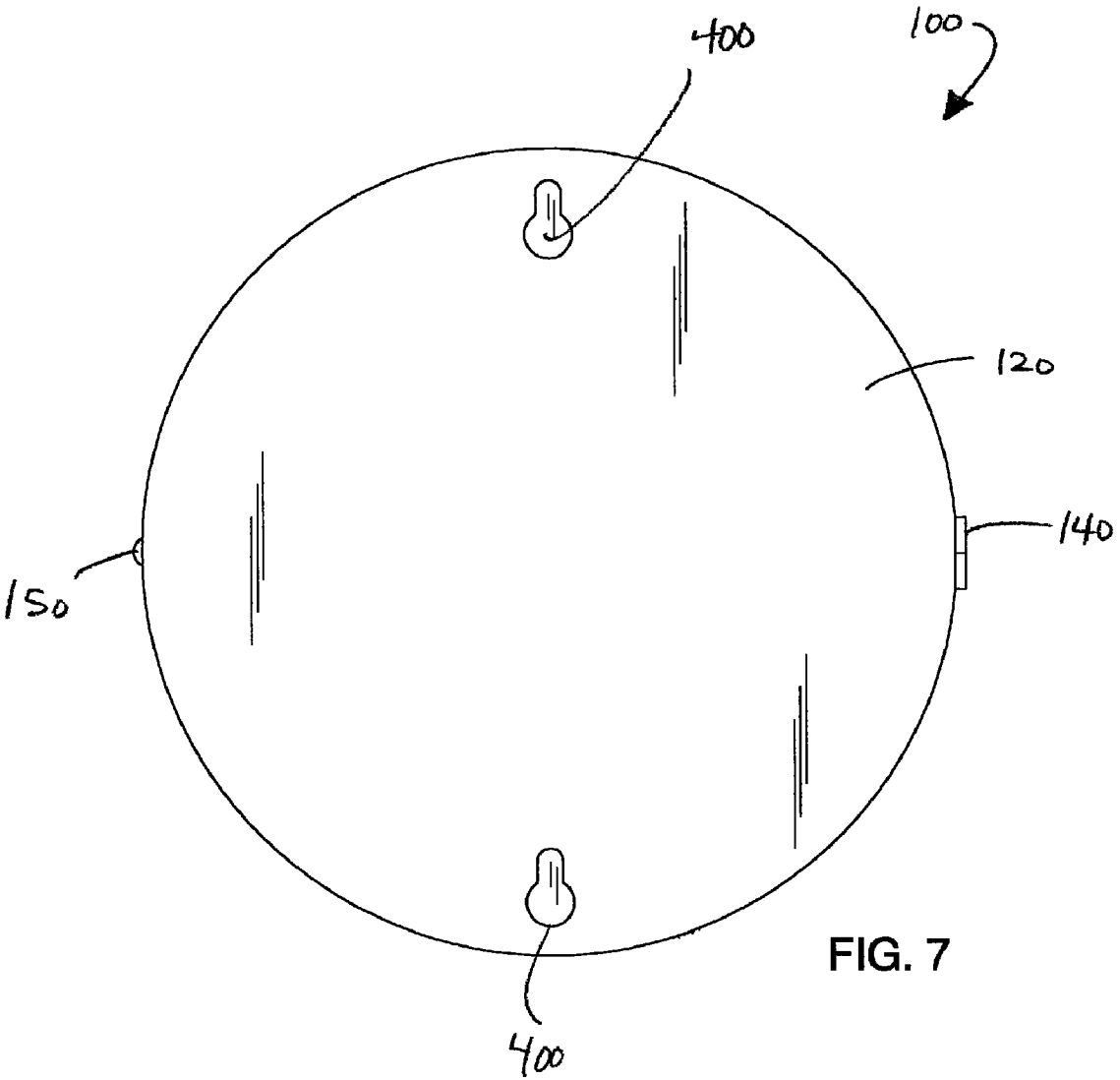
FIG. 7 is a back view of the accessory storage compartment of the present invention.

In some embodiments, an inner compartment 210 is disposed on the inside surface 121 of the back face 120 of the accessory storage compartment 100 (see FIG. 3, FIG. 5). The inner compartment 210 is for storing a variety of items, such as watches, bracelets, other pieces of jewelry, the like, or a combination thereof. The inner compartment 210 has a top edge, a bottom edge, and an inner compartment door 250 that can be moved between an open position and a closed position via a hinge disposed on the bottom edge. At the top edge is a clasp 450 for securing the inner compartment door 250 in the closed position.

The accessory storage compartment 100 may be constructed in a variety of sizes. For example, in some embodiments, the accessory storage compartment 100 is between about 6 to 12 inches in diameter. In some embodiments, the accessory storage compartment 100 is between about 12 to 15 inches in diameter. In some embodiments, the accessory storage compartment 100 is between about 15 to 18 inches in diameter. In some embodiments, the accessory storage compartment 100 is more than about 18 inches in diameter.

As used herein, the term "about" refers to plus or minus 10% of the referenced number. For example, an embodiment wherein the accessory storage compartment 100 is about 10 inches in diameter includes an accessory storage compartment 100 that is between 9 and 11 inches in diameter.

The following the disclosures of the following U.S. Patents are incorporated in their entirety by reference herein: U.S. Pat. No. 3,613,873; U.S. Pat. No. 4,371,077; U.S. Pat. No. 3,930,702; U.S. Pat. No. 658,488; U.S. Pat. No. 6,584,042; B1.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An accessory storage compartment that also functions as a clock, said accessory storage compartment comprising:

(a) a front face, a back face, a first side, and a second side, wherein the first side and the second side are both openable via a hinge disposed on the first side to form a first half and a second half; wherein the front face has an inside surface and the back face has an inside surface;

(b) a button clasp disposed on first half of the accessory storage compartment on the second side, wherein the button clasp is for securing the first half and the second half together by hooking into a notch disposed on the second half of the accessory storage compartment on the second side;

(c) a clock disposed on the front face of the accessory storage compartment, wherein the clock is controlled by a time control panel disposed on the inside surface of the front face;

(d) a plurality of hooks attached to the inside surface of the back face of the accessory storage compartment for hanging necklaces, bracelets, chains, or a combination thereof;

(e) a ring holding apparatus attached to the inside surface of the back face of the accessory storage compartment for holding rings, earrings, or a combination thereof;

(f) an earring grid attached to the inside surface of the back face of the accessory storage compartment via one or more posts, wherein the earring grid is for holding earrings, or a combination thereof; and (g) a mounting hole disposed on the back face of the accessory storage compartment for receiving a nail, a bolt, a screw, so as to mount the accessory storage compartment on a wall or other similar structure;

wherein the accessory storage compartment further comprises an inner compartment disposed on the inside surface of the back face of the accessory storage compartment;

wherein the inner compartment comprises an inner compartment door that can be moved between an open position and a closed position via a hinge disposed on a bottom edge of the inner compartment.

2. The accessory storage compartment of claim 1, wherein a clasp is disposed at a top edge of the inner compartment for securing the inner compartment door in the closed position.

3. The accessory storage compartment of claim 1, wherein the accessory storage compartment is between about 6 to 18 inches in diameter.

* * * * *